US009508273B2

(12) United States Patent
Hermes, III

(10) Patent No.: US 9,508,273 B2
(45) Date of Patent: Nov. 29, 2016

(54) VALUE ORIENTED ILLUMINATED SIGN THAT IS EASILY CUSTOMIZABLE

(71) Applicant: George Jacob Hermes, III, Hartland, WI (US)

(72) Inventor: George Jacob Hermes, III, Hartland, WI (US)

( * ) Notice: Subject to any disclaimer, the term of this patent is extended or adjusted under 35 U.S.C. 154(b) by 12 days.

(21) Appl. No.: 14/875,853

(22) Filed: Oct. 6, 2015

(65) Prior Publication Data

US 2016/0111029 A1 Apr. 21, 2016

Related U.S. Application Data

(60) Provisional application No. 62/064,972, filed on Oct. 16, 2014.

(51) Int. Cl.
*G09F 13/18* (2006.01)
*G09F 13/22* (2006.01)

(52) U.S. Cl.
CPC ..... *G09F 13/18* (2013.01); *G09F 13/22* (2013.01); *G09F 2013/222* (2013.01)

(58) Field of Classification Search
CPC ..... G09F 13/18; G09F 2013/1831; G09F 2013/1836; G09F 2013/222
See application file for complete search history.

(56) References Cited

U.S. PATENT DOCUMENTS 3,771,243 A * 11/1973 Rolph ..... G09F 21/04 40/591
5,485,145 A * 1/1996 Sniff ..... G08B 7/062 340/815.4
2008/0162154 A1* 7/2008 Fein ..... G06Q 10/06 705/14.4
2009/0100727 A1* 4/2009 Chen ..... G09F 13/20 40/546
2009/0251885 A1* 10/2009 Yen ..... G09F 13/18 362/97.1
2011/0051395 A1* 3/2011 Field ..... G09F 13/08 362/84
2011/0167690 A1* 7/2011 Bjarnason ..... G02B 6/0021 40/582
2012/0036750 A1* 2/2012 Ryul ..... G09F 13/14 40/546
2013/0188335 A1* 7/2013 Marche ..... F21S 4/006 362/103
2013/0318843 A1* 12/2013 Nimtz ..... G09F 13/00 40/559
2014/0369071 A1* 12/2014 Fallon ..... G09F 13/18 362/612
2015/0192262 A1* 7/2015 Champagne ..... G09F 13/18 40/714
2015/0325157 A1* 11/2015 Jumblatt ..... G09F 13/22 40/581

* cited by examiner

*Primary Examiner* — Gary Hoge
(74) *Attorney, Agent, or Firm* — Dunlap Bennett & Ludwig PLLC

(57) ABSTRACT

A value oriented outdoor illuminated sign that is easily customizable is disclosed. It provides low energy use, efficient illumination for a minimum of 30 days when operated on included timer with no need for an extension cord or outlet.

20 Claims, 3 Drawing Sheets

VALUE ORIENTED ILLUMINATED SIGN THAT IS EASILY CUSTOMIZABLE

CROSS-REFERENCE TO RELATED APPLICATION

This application claims the benefit of priority of U.S. provisional application No. 62/064,972 filed Oct. 16, 2014, the contents of which are herein incorporated by reference.

BACKGROUND OF THE INVENTION

The present invention relates to signage and, more particularly, to illuminated signage that is customizable. Currently, there is a challenge to have a custom outdoor sign lighted inexpensively without the need to plug into an electrical source. These current methods are expensive and require intensive labor.

As can be seen, there is a need for a lighted advertising sign that may be easy to customize, inexpensive and with no need for plugging into a power source.

SUMMARY OF THE INVENTION

In one aspect of the present invention, a signage device comprises a substrate having a channel defined in at least one surface of the substrate and has an inner portion to present indicia of a message conveyed by said signage. The signage also has a light strip comprising a plurality of lights disposed on a top surface of the light strip in a spaced apart relation and operatively connected to a power source and the lighting strip is received in the channel.

In some aspects of the invention, the channel is defined around a periphery the at least one surface of the substrate. The light strip may extend around the periphery of the at least one surface of the substrate. In other aspects of the invention the substrate and light strip are flexible.

The substrate may further comprise a hole defined in the at least one surface of the substrate; and an electrical connector disposed at an end of the light strip and the electrical connector is received in the hole. The hole may extend to a second surface of the substrate with a connector channel defined in the second surface, so that the electrical connector is received in the connector channel.

The power source of the apparatus may comprise a battery contained within the substrate or external to the apparatus, such as on a back surface thereof.

In some embodiments of the signage, the light strip is formed as an open loop and the connector is attached at a first end of the light strip. Alternatively, the light strip may be formed in a closed loop. In a preferred embodiment, a top surface of the light strip is substantially flush with the surface of the substrate when the strip is received in the channel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a value oriented illuminated signage that is easily customizable.

Figure 1:
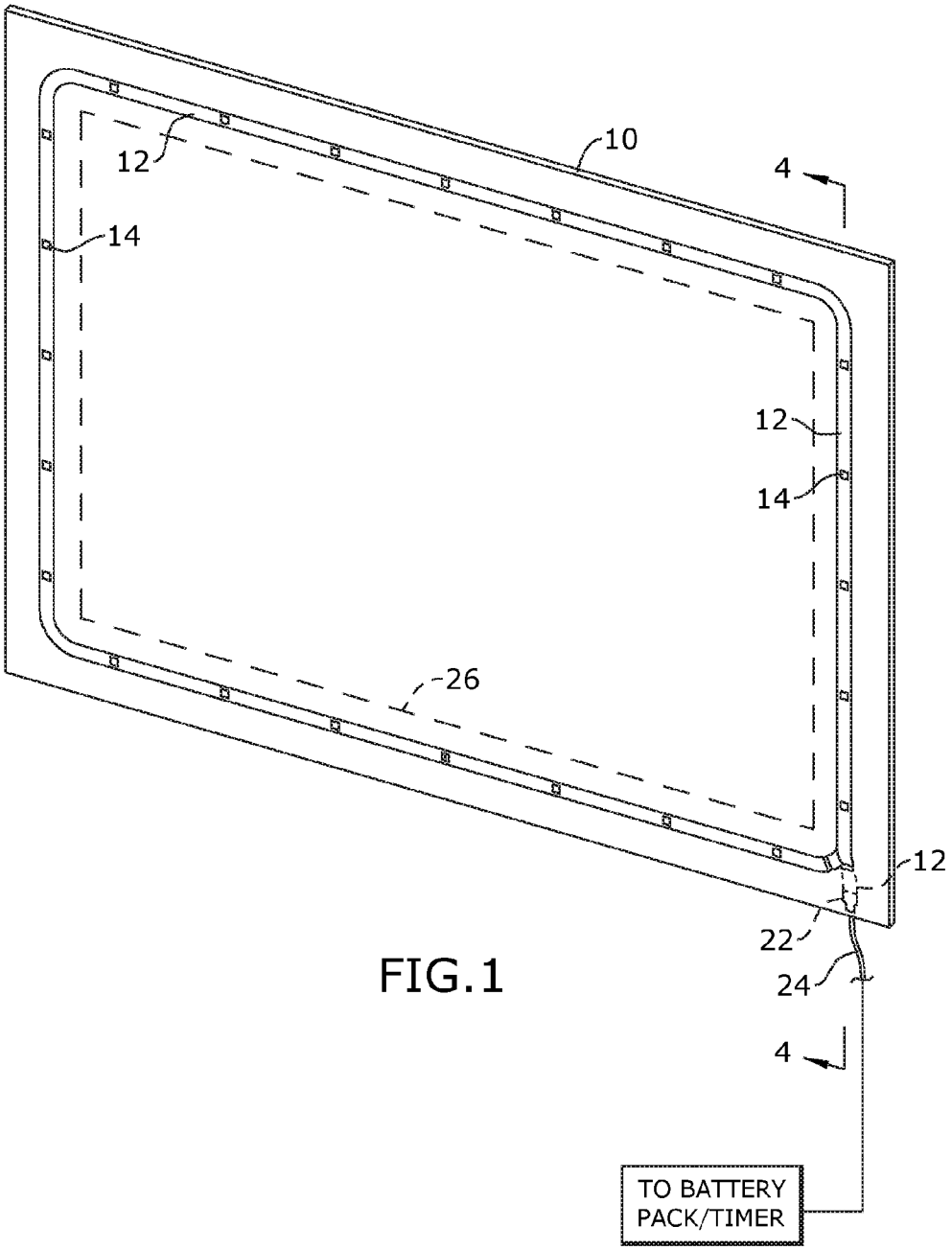
FIG. 1: is a perspective view of an illuminated signage according to an embodiment of the present invention.
Figure 2:
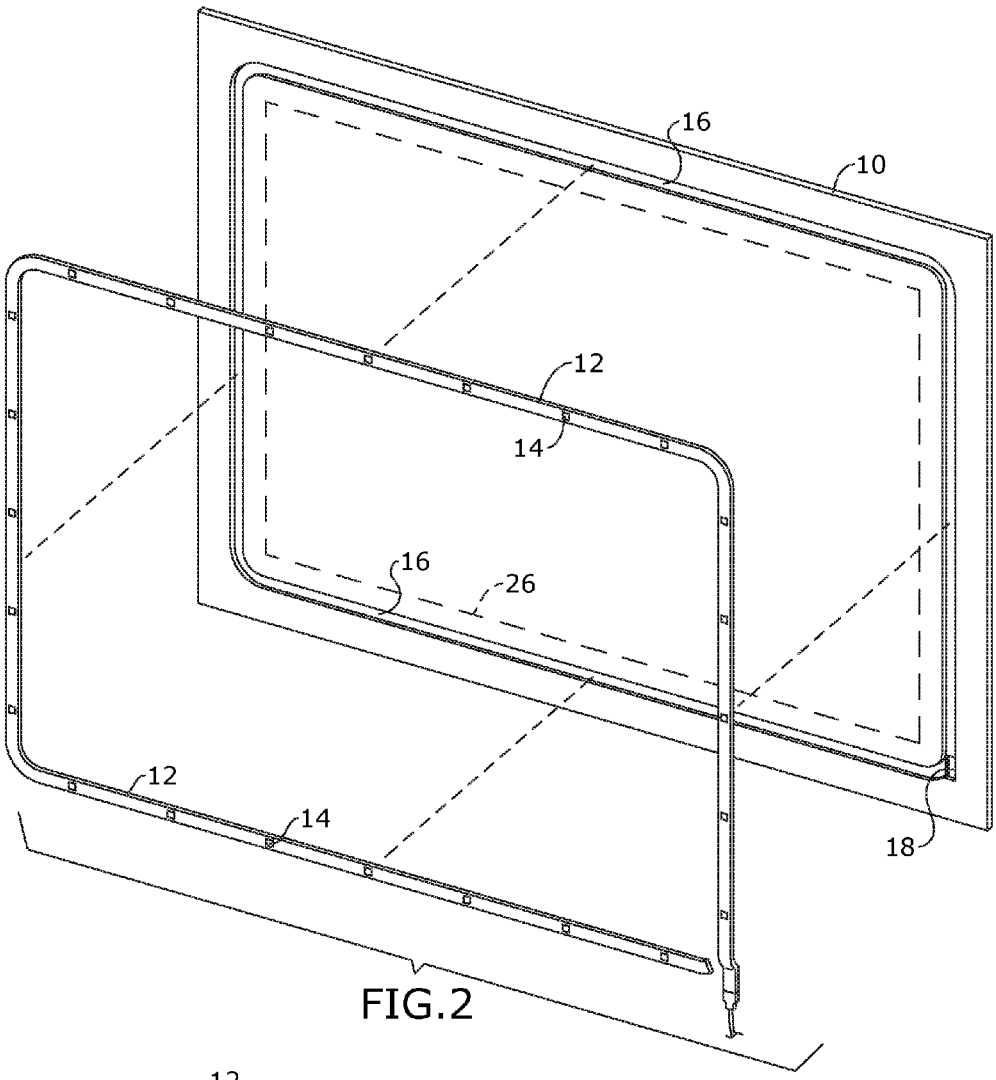
FIG. 2: is a front exploded view of an illuminated signage.
Figure 3A:
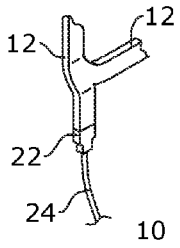
FIG. 3A: is a detail exploded view of an embodiment of a closed loop LED light strip and power connection.
Figure 3B:
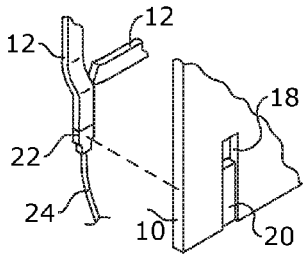
FIG. 3B: is a detail exploded view of an embodiment of an open loop LED light strip and power connection.

As seen in reference to FIGS. 1-3, a lighted advertising sign device 10 may include a sheet, plate, or substrate material 10 such as corrugated plastic, chip board, foam board or the like. Preferably, the substrate 10 is formed of a material that is suited for outdoor use to withstand immersion in rain, high and low temperatures, exposure to the sun, and other environmental conditions. In certain preferred embodiments, the substrate material is selected from a disposable material. In certain other embodiments, the substrate 10 may be a substantially planar sheet. The substrate 10 may be formed as a rectangle, triangle, circle, square, or other geographic shape. In a preferred embodiment, the substrate may be 18 inches×24 inches×¼ inches. The substrate 10 may also be formed of a flexible material. The substrate of material 10 may include a front face and a rear face.

A channel 16 may be cut or formed into at least one face of the substrate 10. In a preferred embodiment, the channel may extend around a periphery of the substrate 10, proximal to an edge surface thereof. In certain preferred embodiments, the channel 16 and substrate 10 may be of a substantially rectangular shape, or in a shape corresponding to the geographic shape of the substrate 10. The channel 16 frames or defines an inner portion 26 of the substrate 10. The inner portion 26 of the substrate 10 provides a surface on which to present printed graphics, text, and other indicia associated with the message to be conveyed by the signage.

A light emitting diode (LED) light strip 12, tube or bulb or the like may be attached or received in the channel 16. In a preferred embodiment of the invention, the light strip 12 is a waterproof, flexible LED tape. More preferably, the LED light strip 12 is a low cost and/or disposable.

Figure 4:
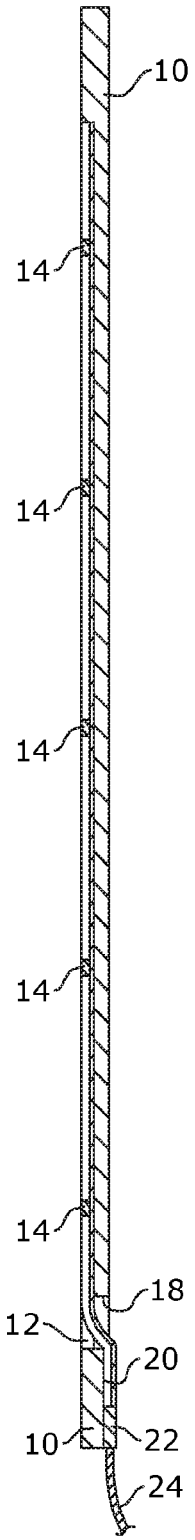
FIG. 4: is a section view of the invention, taken along line 4 of the illuminated signage of FIG. 1.
Figure 5:
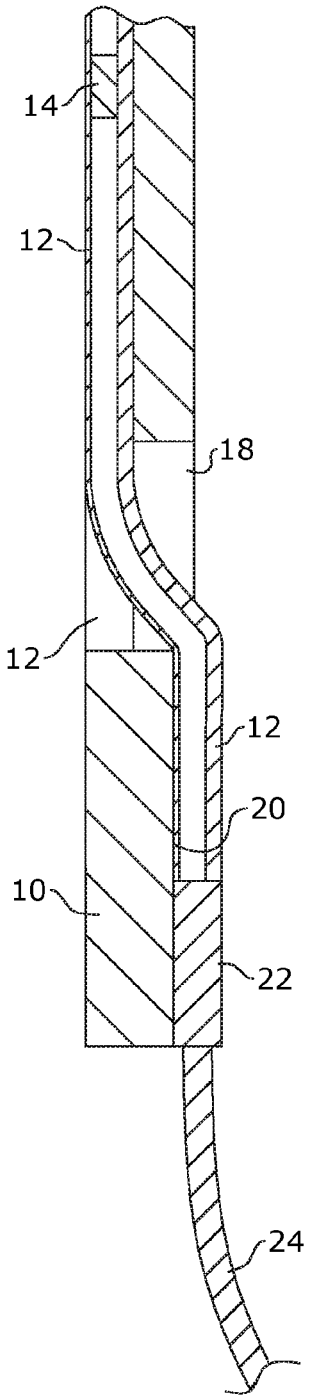
FIG. 5: is a detail section view of an illuminated signage power connection.

The light strip 12, comprises a plurality of LED lights 14, operatively connected to a power source via a connector 22 and a power cord 24. The plurality of LED lights 14 are spaced apart from each other along the length of the strip 12, and may preferably be provided with about 3 inches of spacing between lights 14. In some embodiments of the invention the connector 22 and cord 24 are defined at an end of the LED strip 12. The light strip 12 may be defined in a closed or open loop. In some preferred embodiments, the light strip may be formed of a flexible material. However, as will be appreciated, the connector 22 placement is not critical to the functioning of the signage of the present invention. As best seen in reference to FIG. 2, the LED light strip 12 may be received in the channel 16. More preferably, as seen in reference to FIG. 4, the light strip may be received in channel 16 so that a top surface of the light strip 12 is flush with the surface of the substrate 10. The light strip 12 and associated LED lights 14 provide illumination to the inner portion 26 of the substrate 10 so that the message conveyed by the signage may be illuminated.

The LED light strip 12 may be powered by a power source, such as a battery (not shown), a wall outlet, or the like. The battery may be placed on a rear side of the substrate 10. Alternatively the battery may be positioned within the substrate 10, or external to a peripheral edge thereof, so as to provide both a front and rear surface of the substrate 10 for the presentation of the message conveyed by the signage and provide for a LED strip 12 to illuminate the signage on both faces.

As may be seen in reference to FIGS. 2 and 3, the substrate may further comprise a hole 18, through which an end of the LED strip 12, connector 22, or power cord 24 may extend so as to provide a connection with the power source. In the embodiment depicted, the hole 18 may extend through to a back surface of the signage and may further comprise a channel 20 for receiving an end of the LED strip, the connector 22, and/or the cord 24. Alternatively, the hole 18 may extend to the interior of the substrate 10 and the channel 20 may be in communication with a battery housing within the signage substrate 10.

In certain embodiments, the LED light strip 12 may be glued onto the substrate 10. A method of using the device may include the following. A person my print their custom message on a weather resistant board and then place the sign device 10 in a desired location. The person may then turn on the power source, such as a battery (power source may be solar or a/c). The power source may be on a selectable timer. For example the power may run for 4-6 hours, during darkness hours, turn off for approximately 18-20 hours, then turn back on again for approximately 4-6 hours. The light may continue the cycle for the life of the power source at a consistent level of illumination. At the end of the battery life, the signage may be disposed of, or the batteries may be replaced.

In certain embodiments, the sign may be used for traffic signs, seasonal decorations, store signage, events, or the like. The substrate 10 of the device may still be able to run through a flatbed printer since the LED light 12 may be flush with the surface of the board material 10.

In a preferred embodiment of the invention, a person who would have a need to advertise a product, service or event outdoors in a location that is not necessarily conducive to hard wire or use A/C power. Since this product is outside and it gets dark in the evening, the consumer can light the yard sign using alternate sources such as battery as the LEDs are efficient. Also key is the inexpensive nature of the product allowing it to be economical to acquire and run leading toward the possibility of having sings in multiple locations selling or calling attention to one's cause more effectively. Additionally, the invention could be used in any environment where an effective lighted sign is needed whether it is outdoors or not.

It should be understood, of course, that the foregoing relates to exemplary embodiments of the invention and that modifications may be made without departing from the spirit and scope of the invention as set forth in the following claims.

What is claimed is:

1. A signage apparatus, comprising:

a substantially planar substrate comprising a channel defined in at least one surface of the substrate and an inner portion of the at least one surface of the substrate to present indicia of a message conveyed by said signage;

a light strip comprising a plurality of lights disposed in a spaced apart relation and adapted to be connected to a power source, wherein said lighting strip is received in said channel to illuminate outwardly from an opening of the channel.

2. The apparatus of claim 1 wherein said channel is defined around a periphery of the at least one surface of the substrate.

3. The apparatus of claim 2 wherein the light strip extends around the periphery of the at least one surface of the substrate.

4. The apparatus of claim 1, wherein the substrate and light strip are flexible.

5. The apparatus of claim 1 wherein the substrate further comprises, a hole defined in the at least one surface of the substrate; and an electrical connector disposed at an end of the light strip, wherein the electrical connector is received in the hole.

6. The apparatus of claim 5, wherein the power source comprises a battery.

7. The apparatus of claim 5, wherein the hole extends to a second surface of the substrate, a connector channel is defined in the second surface, and the electrical connector is received in the connector channel.

8. The apparatus of claim 5, wherein a top surface of the light strip is substantially flush with the surface of the substrate.

9. The apparatus of claim 7, wherein the power source comprises a timer.

10. The apparatus of claim 7, wherein the light strip is formed in an open loop and the connector is attached at a first end of the light strip.

11. The apparatus of claim 7, wherein the light strip is formed in a closed loop.

12. The apparatus of claim 1, wherein the lights are light emitting diodes.

13. The apparatus of claim 1, wherein the substrate and light strip are flexible.

14. A signage apparatus, comprising:

a substrate comprising a channel defined in at least one surface of the substrate and an inner portion of the at least one surface of the substrate to present indicia of a message conveyed by said signage;

a light strip comprising a plurality of lights disposed in a spaced apart relation, an electrical connector disposed at an end of the light strip and adapted to be connected to a power source, wherein said lighting strip is received in said channel;

a hole defined in the at least one surface of the substrate wherein the hole extends to a second surface of the substrate; wherein the electrical connector is received in the hole; and a connector channel defined in the second surface, and the electrical connector is received in the connector channel.

15. The apparatus of claim 14, wherein the power source comprises a battery.

16. The apparatus of claim 14, wherein the light strip is formed in an open loop and the connector is attached at a first end of the light strip.

17. The apparatus of claim 14, wherein the light strip is formed in a closed loop.

18. The apparatus of claim 14, wherein a top surface of the light strip is substantially flush with the surface of the substrate.

19. The apparatus of claim 14, wherein the lights are light emitting diodes.

20. The apparatus of claim 14 wherein said channel is defined around a periphery of the at least one surface of the substrate.

* * * * *